US007220909B2

(12) United States Patent
Funaki

(10) Patent No.: US 7,220,909 B2
(45) Date of Patent: May 22, 2007

(54) APPARATUS FOR DISPLAYING MUSICAL INFORMATION WITHOUT OVERLAP

(75) Inventor: Tomoyuki Funaki, Hamamatsu (JP)

(73) Assignee: Yamama Corporation (JP)

( * ) Notice: Subject to any disclaimer, the term of this patent is extended or adjusted under 35 U.S.C. 154(b) by 0 days.

(21) Appl. No.: 11/233,390

(22) Filed: Sep. 22, 2005

(65) Prior Publication Data

US 2006/0065100 A1 Mar. 30, 2006

(30) Foreign Application Priority Data

Sep. 22, 2004 (JP) ..... 2004-274530

(51) Int. Cl.
*A63H 5/00* (2006.01)
*G04B 13/00* (2006.01)
*G10H 7/00* (2006.01)

(52) U.S. Cl. ..... 84/609; 84/477 R; 84/478

(58) Field of Classification Search ..... 84/609, 84/477 R, 478
See application file for complete search history.

(56) References Cited

U.S. PATENT DOCUMENTS 6,053,740 A * 4/2000 Nakata et al. ..... 434/307 A
6,062,867 A * 5/2000 Torimura ..... 434/307 A
6,235,979 B1 5/2001 Yanase
6,582,235 B1 * 6/2003 Tsai et al. ..... 434/307 A
6,838,608 B2 * 1/2005 Koike ..... 84/477 R
7,094,960 B2 * 8/2006 Ikeya et al. ..... 84/471 R
2001/0023633 A1 * 9/2001 Matsumoto ..... 84/478
2002/0103759 A1 8/2002 Matsumoto et al.
2002/0107803 A1 8/2002 Lisanke et al.
2003/0192424 A1 * 10/2003 Koike ..... 84/477 R (Continued)

FOREIGN PATENT DOCUMENTS

CN 1753080 A 3/2006

(Continued)

OTHER PUBLICATIONS

Relevant portion of European Search Report dated Dec. 18, 2006 for corresponding European Patent Application EP 03103512.

*Primary Examiner*—Jeffrey W. Donels
(74) *Attorney, Agent, or Firm*—Rossi, Kimms & McDowell, LLP

(57) ABSTRACT

A musical information displaying apparatus is to display musical notes in progression along the time axis on a musical staff together with chords and words based on the respective event data contained in a music performance data file representing a musical performance. The chords are displayed at their event positions along the time axis in the open space above and nearest to the musical staff. If two adjacent chords would overlap in part when displayed at the same vertical level in view of the respective display lengths, the vertical position of the latter chord will be shifted to prevent overlapping. The character representing the root of the chord will be displayed in an enhanced font than the other characters of the chord name. Where the words are displayed in correspondence to the notes, the words are to be displayed primarily at the positions along the time axis corresponding to the notes. If two adjacent words would overlap in part when displayed in view of the respective display lengths, the horizontal position of the latter word will be adjusted to prevent overlapping. The right–justification rule is also introduced.

7 Claims, 11 Drawing Sheets

Hardware Configuration of Musical Information Displaying System

How to Prevent Overlap of Displayed Chord Names

U.S. PATENT DOCUMENTS

2004/0112201 A1* 6/2004 Funaki ..... 84/477 R
2004/0244567 A1* 12/2004 Asakura ..... 84/613

FOREIGN PATENT DOCUMENTS

EP 1 640 967 A2 3/2006
JP 11-327427 11/1999
JP 2006-91221 A 4/2006
WO 9812876 A1 3/1998

* cited by examiner

Hardware Configuration of Musical Information Displaying System

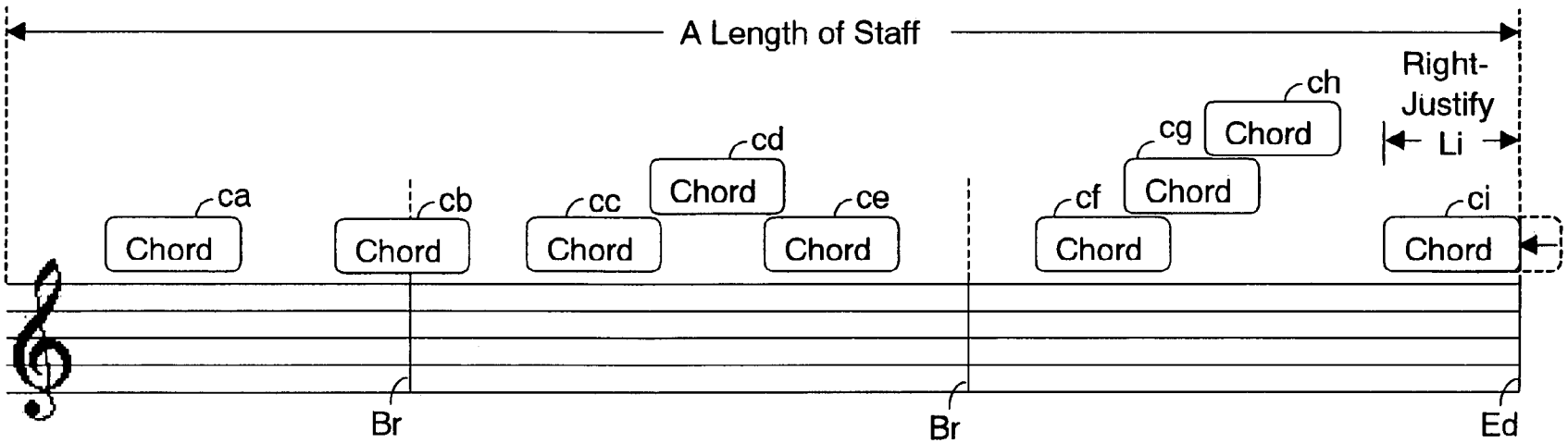
Fig.2a How to Prevent Overlap of Displayed Chord Names
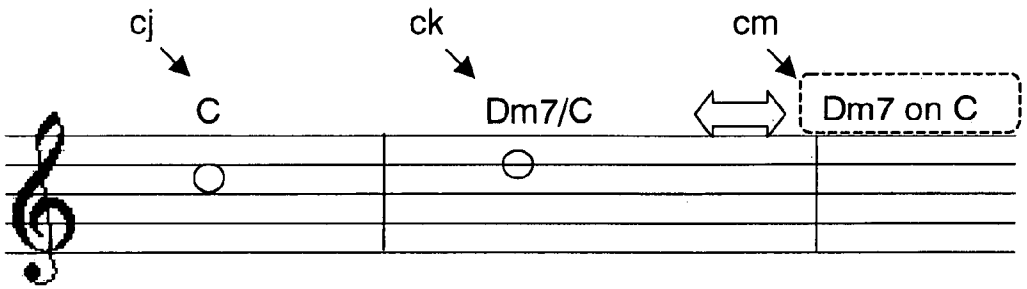
Fig.2b Highlighting Root of Chord Names

*Fig.2c* Overlap of Displayed Words
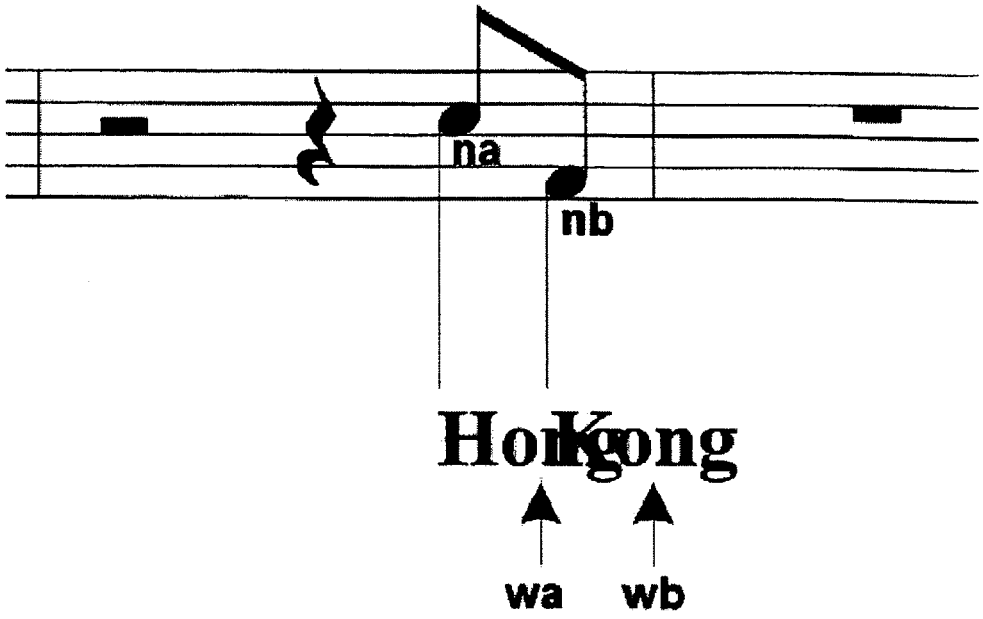
*Fig.2d* Preventing Overlap of Displayed Words by Right Shift
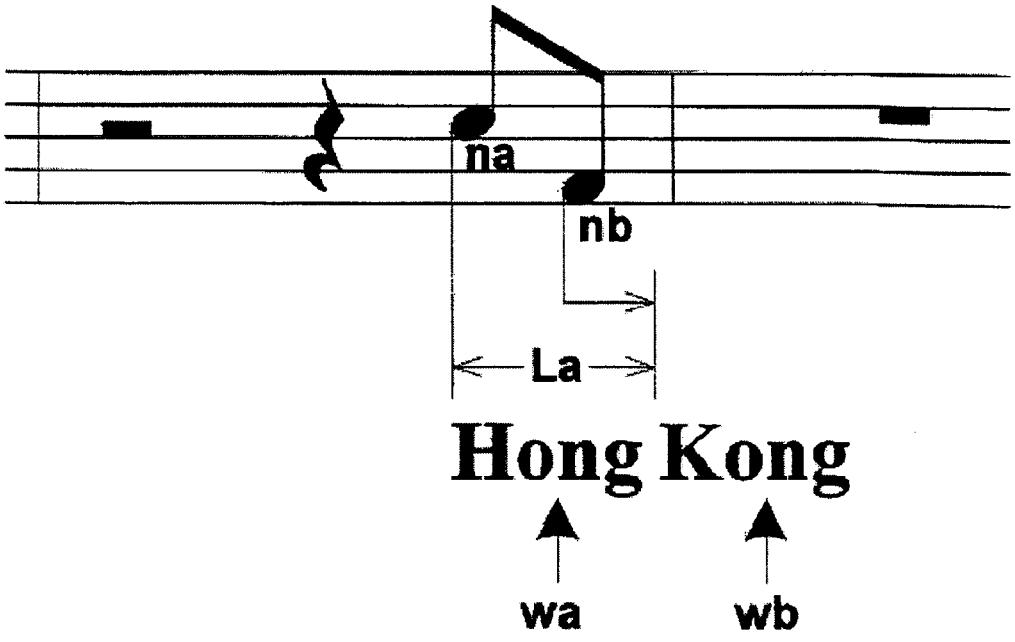

*Fig.2e* Overlap and Overrun of Displayed Words
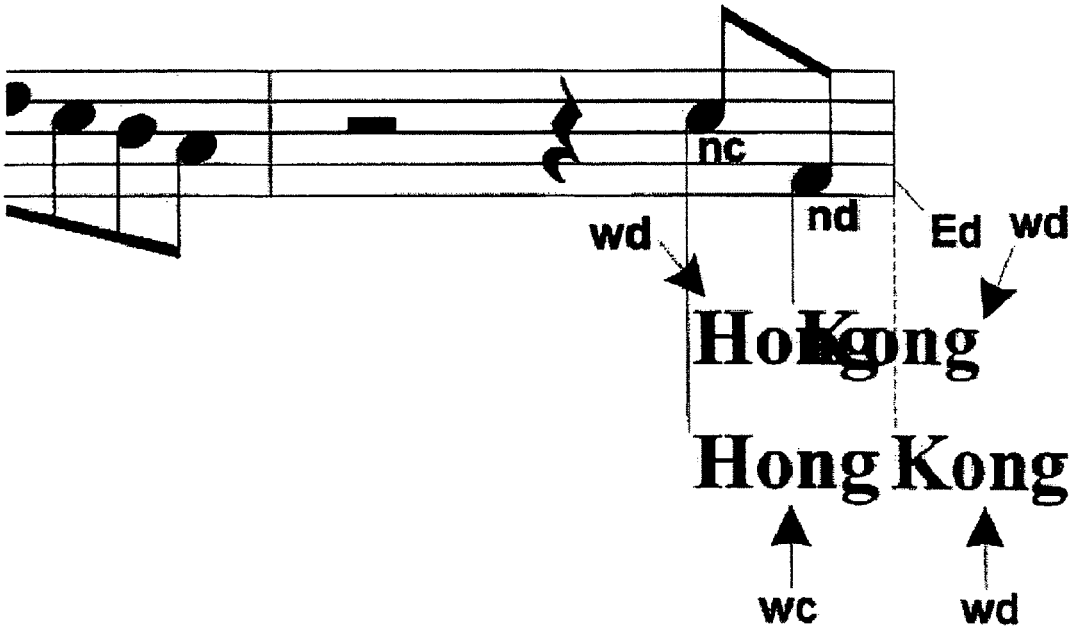
*Fig.2f* Preventing Overlap and Overrun of Displayed Words by Right-Justify
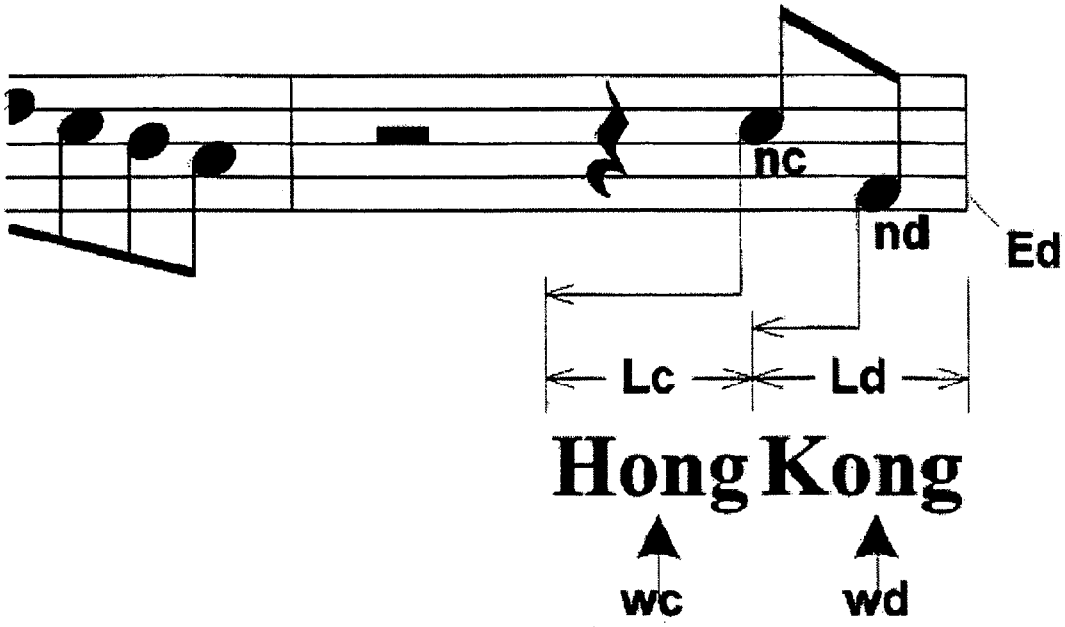

*Fig. 3a* Processing for Creating Chord Display Data (Part 1)
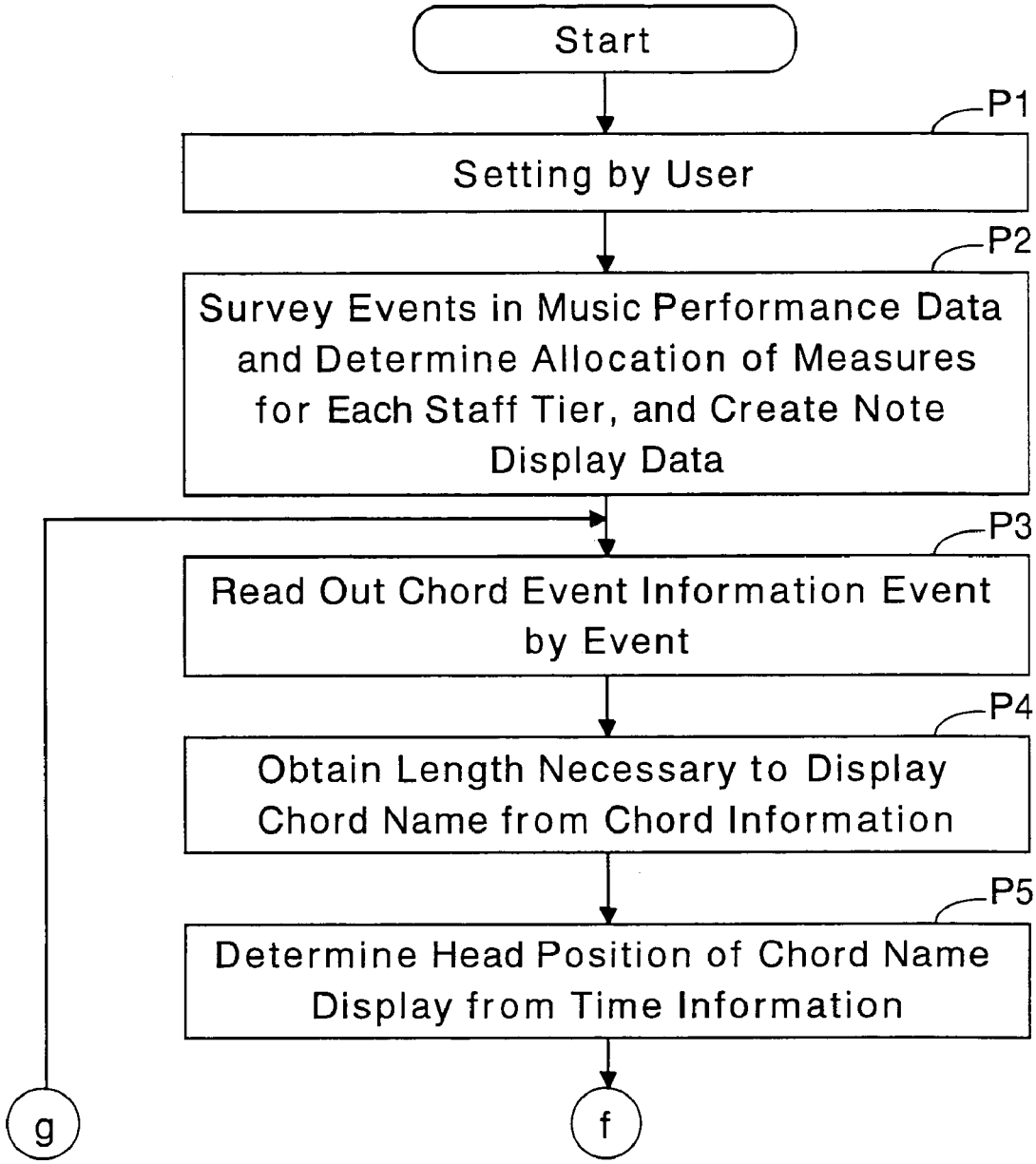

*Fig. 3b* Processing for Creating Chord Display Data (Part 2)
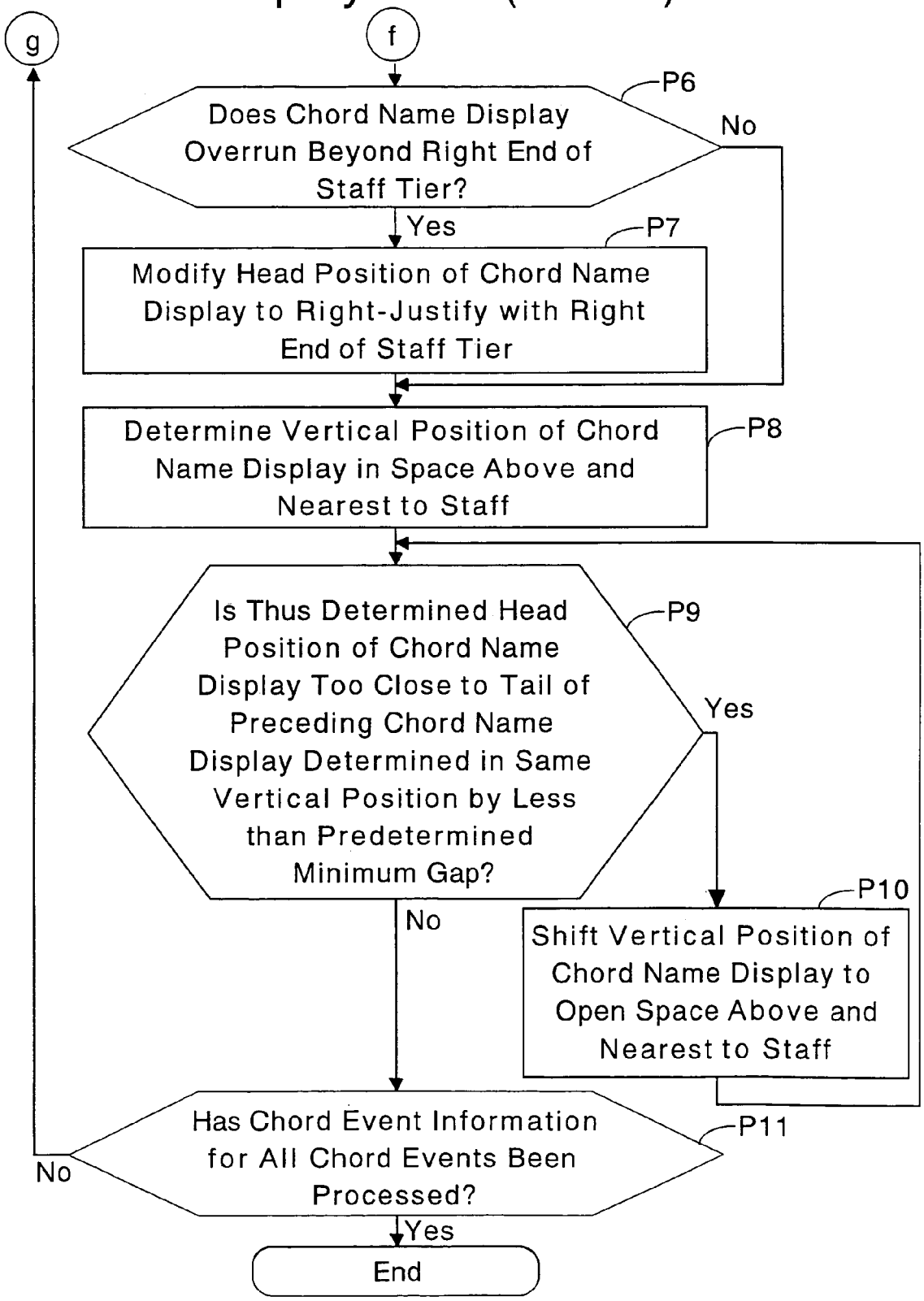

*Fig. 4a* Processing for Creating Word Display Data (Part 1)
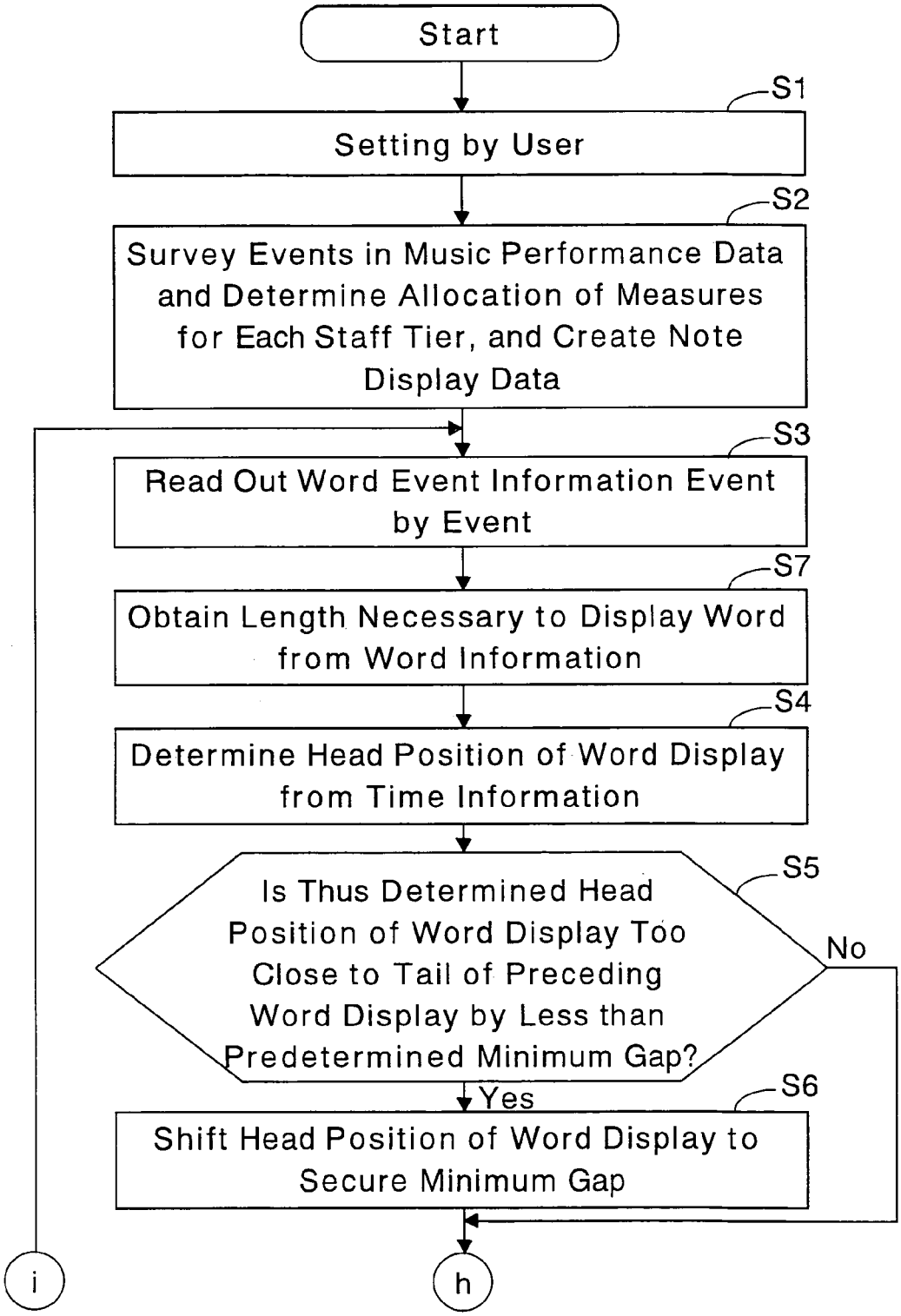

*Fig. 4b* Processing for Creating Word Display Data (Part 2)
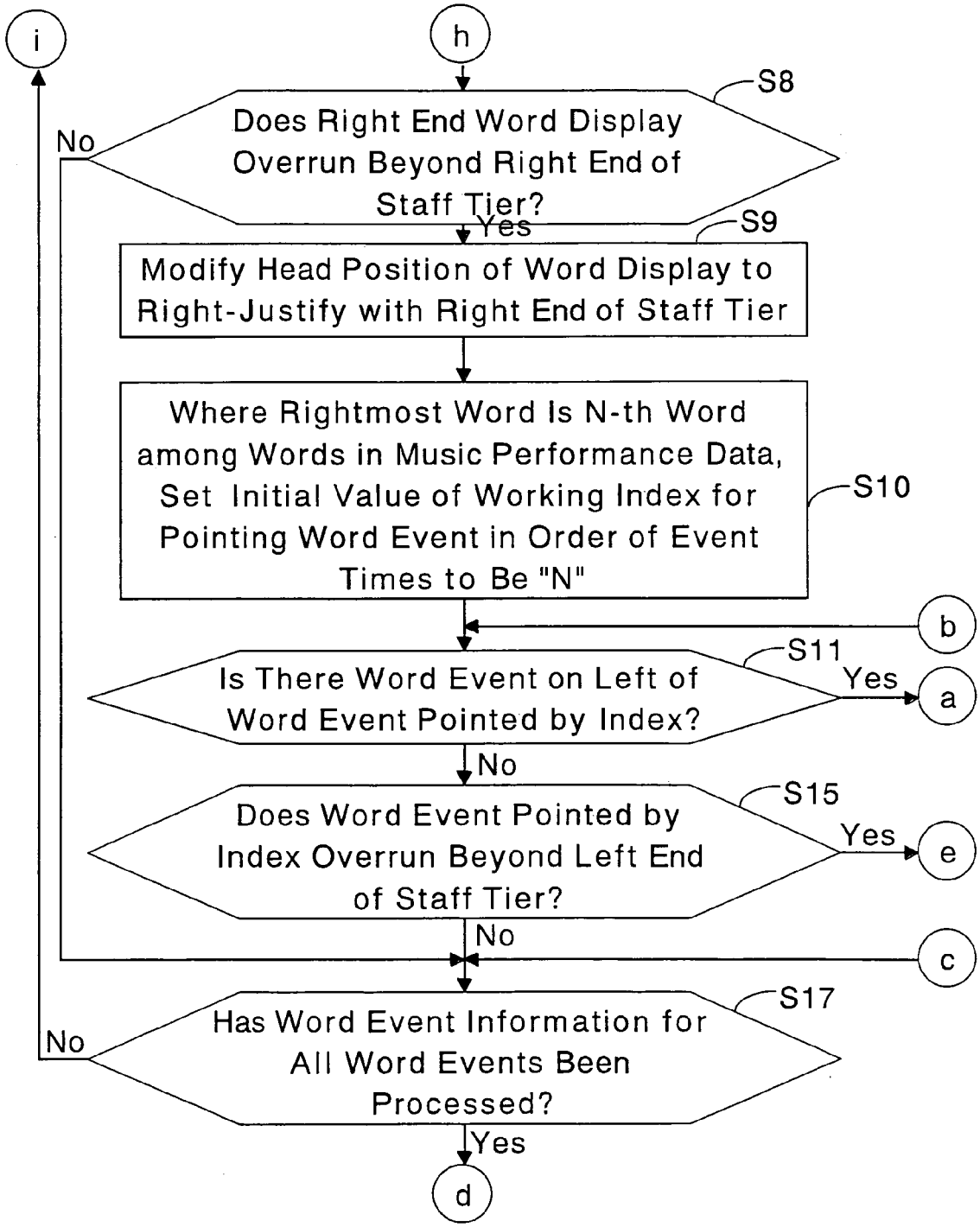

*Fig. 4c* Processing for Creating Word Display Data (Part 3)
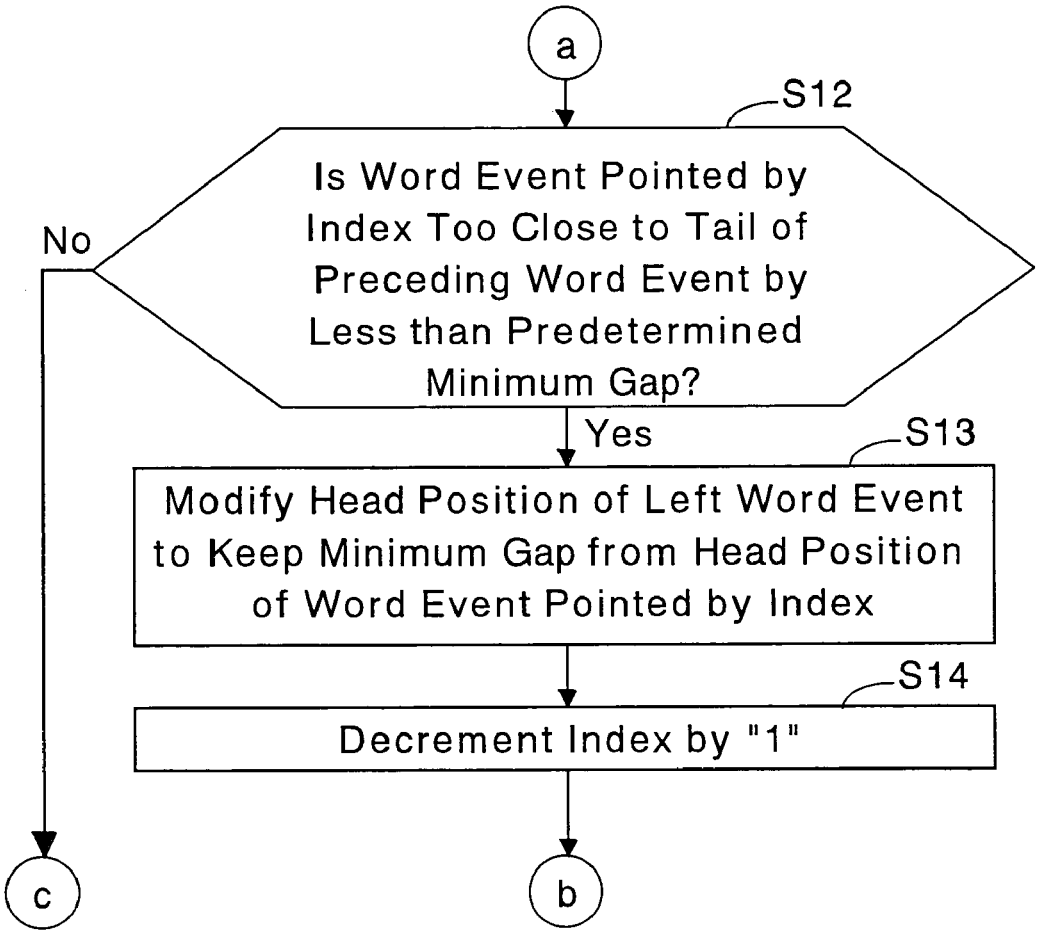

*Fig. 4d* Processing for Creating Word Display Data (Part 4)
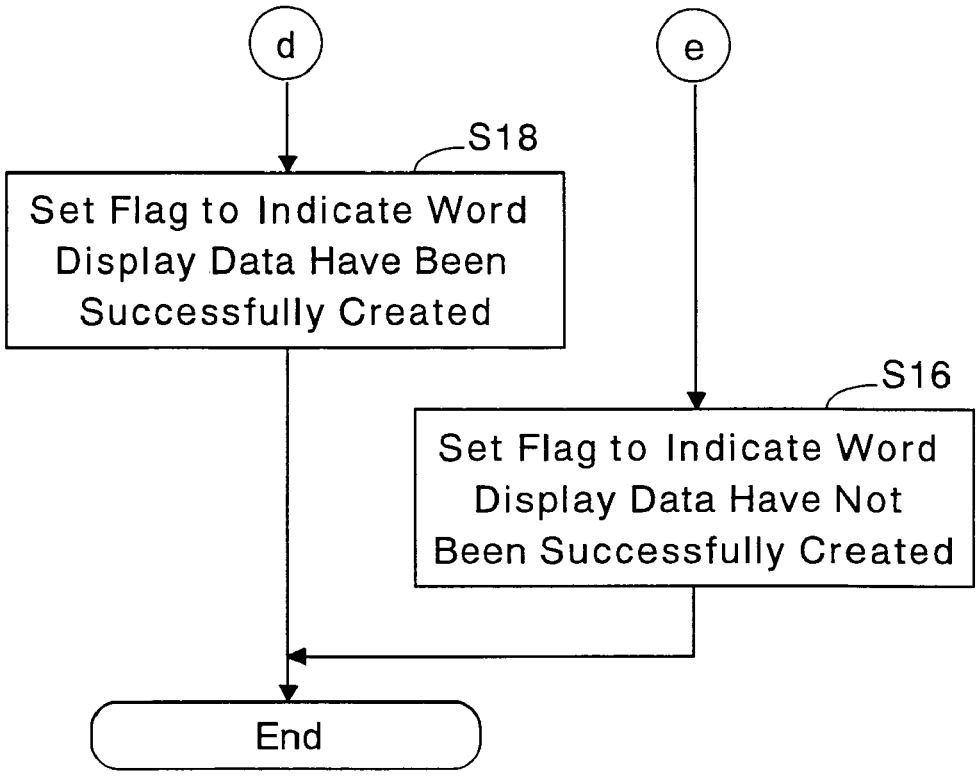

*Fig.5* Format of Music Performance Data
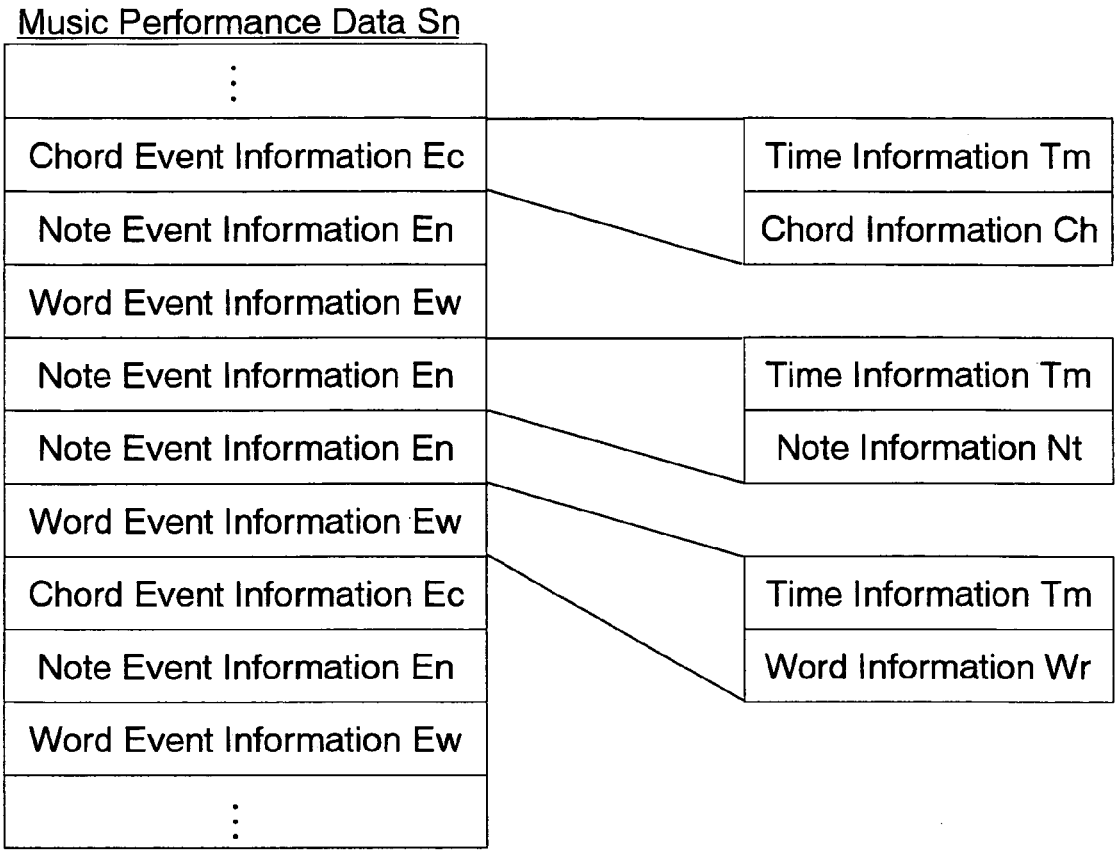

APPARATUS FOR DISPLAYING MUSICAL INFORMATION WITHOUT OVERLAP

TECHNICAL FIELD

The present invention relates to a musical information displaying apparatus incorporating an arrangement for preventing overlapped displays and a computer readable medium containing program instructions therefor, and more particularly to a musical information displaying apparatus and a computer readable medium containing program instructions capable of displaying musical notes in progression along the time axis on a musical staff together with chords and words based on the respective event data contained in a music performance data file representing a musical performance, wherein the chords are displayed at their event positions along the time axis and at vertical levels near the musical staff preventing mutual overlaps, and the words are displayed near the corresponding notes along the time axis with their horizontal positions adjusted to prevent mutual overlapping.

BACKGROUND INFORMATION

Various types of musical information displaying apparatuses capable of displaying a musical score in a better understandable appearance, i.e. in an improved layout of the notational symbols based on an automatic music performance data file. An example of such musical information displaying apparatuses is disclosed in U.S. Pat, No. 6,235,979 in which the length of a displayed measure and the allocation of displayed notes in the measure are properly adjusted so that the notes at different times should be displayed without an overlap between any adjacent notes. This patent, however, does not consider the chord names and the words to be displayed in association with the notes on the musical score.

Typically, a musical score describing musical information displayed along the time axis on a music score displaying apparatus contains chord names located near the musical staff to represent chords by a character string (sometime of a single character, and sometime of several characters). Usually, the left end (head position) of the displayed chord name indicates the time point along the time axis at which the displayed chord is to substitute the theretofore prevailing chord.

Under these circumstances, in the case of a chord name with a long character string such as, for example, the chord "C#M7aug" (C# major seventh augmented), the displayed character string may sometimes extend over to the display position of the next chord so that the chord names of the two chords might be partly intermingled to become illegible or hardly legible for the user. Further, in the case of a chord name with a non-root bass (often referred to as an "on-bass chord") such as, for example, the chord "C on E" (C major on bass of E) or sometimes expressed as "C/E," the tail character "E" indicating the bass note to be played with the constituent notes of the chord "C" may be confused with a new chord name, even though two consecutive chord names are not displayed overlapping with each other.

A musical score sometimes contains also words to the melody. In the case where the words are displayed in connection with the notes on the music score, the words are typically aligned along the time axis of the note progression and placed at the positions of the respectively corresponding note symbols. However, if the distance between the two displayed consecutive note symbols are too short, the two words may sometimes overlap in part with each other, just like in the case of the above-mentioned chord name display, and may be illegible or hardly legible.

SUMMARY OF THE INVENTION

It is, therefore, a primary object of the present invention to solve the drawbacks with the conventional apparatus, and to provide a novel type of musical information displaying system which can display a music score containing chord names and/or words together with the notes based on a music performance data file, in which the chord names and/or the words are displayed in a better appearance for the user to read by preventing overlapped displays and/or by highlighting the roots of the chords.

According to the present invention, the object is accomplished by providing an apparatus for displaying musical information including a plurality of chords in association with notes displayed along a time axis on a musical staff comprising: a music performance data providing device which provides music performance data containing note data representing notes in progression along a time axis to constitute a musical performance, and chord data representing chords in progression in association with the notes; a first determining device which determines a display length and a display position of each of the chords along the time axis based on the chord data contained in the music performance data; a detecting device which detects an overlap of chords in the direction of the time axis when displayed based on the determined display lengths and the determined display positions of the respective chords along the time axis; a second determining device which determines a vertical display position of a chord of which no overlap with another chord is detected to be at a predetermined standard vertical position in a direction perpendicular to the time axis, and determines a vertical display position of a chord of which an overlap with another chord is detected to be at a vertical position which is vertically apart from the other chord by at least a predetermined gap; and a display device which displays each of the chords at the position in the direction of the time axis as determined by the first determining device and at the vertical position as determined by the second determining device. Thus, an overlap of the adjacent chord names when displayed will be prevented by shifting the vertical position of the latter chord display with respect to the vertical position of the former chord display of the otherwise overlapping chord displays, keeping the positions of the respective chords along the time axis exact.

In an aspect of the present invention, the standard vertical position may be a position vertically nearest to the musical staff; and the detecting device may be so arranged to detect at least two consecutive overlaps among at least three consecutive chords; and the second determining device will determine a vertical position of a chord among said consecutive chords at a position vertically as near to the musical staff as possible, provided that the chord does not overlap with another of the consecutive chords in the direction of the time axis. Thus, an open space nearer to the musical staff can be efficiently utilized for the chord to be displayed so that the displayed chords will not become unnecessarily far from the musical staff.

According to the present invention, the object is further accomplished by providing an apparatus for displaying musical information including a plurality of chords in association with notes displayed along a time axis on a musical staff comprising: a music performance data providing device which provides music performance data containing note data representing notes in progression along a time axis to constitute a musical performance, and chord data representing at least a chord in association with the notes; and a display control device which controls the display device to display a chord name comprised of a character string based on the chord data contained in the music performance data such that a character representing the root of the chord is displayed in a different fashion from characters in the character string other than the character representing the root. Thus, the user can easily understand (or grasp) the chord names of the respective chords at their correct positions without confusion with the on-bass note names or the like.

According to the present invention, the object is still further accomplished by providing an apparatus for displaying musical information including a plurality of words in correspondence to notes displayed along a time axis on a musical staff comprising: a music performance data providing device which provides music performance data containing note data representing notes in progression along a time axis to constitute a musical performance, and word data representing words in progression in association with the notes; a determining device which determines a display length and a display position of each of the words along the time axis based on the word data contained in the music performance data; a detecting device which detects an overlap of words in the direction of the time axis when displayed based on the determined display lengths and the determined display positions of the respective words along the time axis successively from a top word to subsequent words; a modifying device which modifies, when the detecting device detects an overlap of two adjacent words in the direction of the time axis, the position of the latter of the two adjacent words to a position which is apart from the former of the two adjacent words by at least a predetermined word gap in the direction of the time axis; and a display device which displays the word of which the position is not modified at the position determined by the determining device, and displays the word of which the position is modified at the position modified by the modifying device. Thus, the words will be displayed without an overlap in line along the time axis near the respectively corresponding notes, not staggering vertically. The words can be easily read by the user.

In a further aspect of the present invention, the apparatus for displaying musical information may further comprise: a judging device which judges whether a word to be displayed at the rightmost end along the time axis on the musical staff overruns the right end of the musical staff; and a remodifying device which remodifies the position of the word which is judged to overrun the right end of the musical staff to a position which is right-justified with respect to the right end of said musical staff, and remodifies the positions of the preceding words to prevent overlapped display, if any, of such words; and the display device will display the right-justified word and the preceding word, if any, to be displayed at the positions remodified by the remodifying device. Thus, a musical score with words will be displayed in a further better appearance.

According to the present invention, the object is further accomplished by providing a computer readable medium containing program instructions executable by a computer for causing the computer to execute: a process of providing music performance data containing note data representing notes in progression along a time axis to constitute a musical performance, and chord data representing chords in progression in association with the notes; a process of determining a display length and a display position of each of the chords along the time axis based on the chord data contained in the music performance data; a process of detecting an overlap of chords in the direction of the time axis when displayed based on the determined display lengths and the determined display positions of the respective chords along the time axis; a process of determining a vertical display position of a chord of which no overlap with another chord is detected to be at a predetermined standard vertical position in a direction perpendicular to the time axis, and determining a vertical display position of a chord of which an overlap with another chord is detected to be at a vertical position which is vertically apart from the other chord by at least a predetermined gap; and a process of displaying each of the chords at the position in the direction of the time axis as determined by the process of determining a display length and a display position and at the vertical position as determined by the process of determining a vertical display position, thereby displaying musical information including a plurality of chords in correspondence to the notes displayed along the time axis on the musical staff. Thus, a computer system will work as the above-described apparatus for displaying musical information including chords in correspondence to notes, whereby an overlap of the adjacent chord names when displayed will be prevented by shifting the vertical position of the latter chord display with respect to the vertical position of the former chord display of the otherwise overlapping chord displays, keeping the positions of the respective chords along the time axis exact.

According to the present invention, the object is further accomplished by providing a computer readable medium containing program instructions executable by a computer and causing the computer to execute: a process of providing music performance data containing note data representing notes in progression along a time axis to constitute a musical performance, and word data representing words in progression in association with the notes; a process of determining a display length and a display position of each of the words along the time axis based on the word data contained in the music performance data; a process of detecting an overlap of words in the direction of the time axis when displayed based on the determined display lengths and the determined display positions of the respective words along the time axis successively from a top word to subsequent words; a process of modifying, when the process of detecting detects an overlap of two adjacent words in the direction of the time axis, the position of the latter of the two adjacent words to a position which is apart from the former of the two adjacent words by at least a predetermined word gap in the direction of the time axis; and a process of displaying the word of which the position is not modified at the position determined by the process of determining, and displaying the word of which the position is modified at the position modified by the process of modifying; thereby displaying musical information including a plurality of words in correspondence to the notes displayed along the time axis on the musical staff. Thus, a computer system will work as the above-described apparatus for displaying musical information including words in correspondence to notes, whereby the words will be displayed without an overlap in line along the time axis near the respectively corresponding notes, not staggering vertically so that the words can be easily read by the user.

As will be apparent from the above description, the present invention can be practiced not only in the form of an apparatus, but also in the form of a computer program to operate a computer or other data processing devices. The invention can further be practiced in the form of a method including the steps mentioned herein.

In addition, as will be apparent from the description herein later, some of the structural element devices of the present invention are structured by means of hardware circuits, while some are configured by a computer system performing the assigned functions according to the associated programs. The former may of course be configured by a computer system and the latter may of course be hardware structured discrete devices. Therefore, a hardware-structured device performing a certain function and a computer-configured arrangement performing the same function should be considered a same-named device or an equivalent to the other.

BRIEF DESCRIPTION OF THE DRAWINGS

For a better understanding of the present invention, and to show how the same may be practiced and will work, reference will now be made, by way of example, to the accompanying drawings, in which:

FIGS. 2*a*–2*f* are charts in musical notation illustrating the rules for displaying chord names and words according to embodiments of the present invention;

FIGS. 3*a* and 3*b* show, in combination, a flow chart describing an example of the processing for creating chord display data conducted by a musical information displaying system according to an embodiment of the present invention;

FIGS. 4*a*–4*d* show, in combination, a flow chart describing an example of the processing for creating word display data conducted by a musical information displaying system according to an embodiment of the present invention; and FIG. 5 is a chart showing an example of the data format of the music performance data used in a musical information displaying system according to an embodiment of the present invention.

DETAILED DESCRIPTION OF EMBODIMENTS OF THE INVENTION

Figure 1:
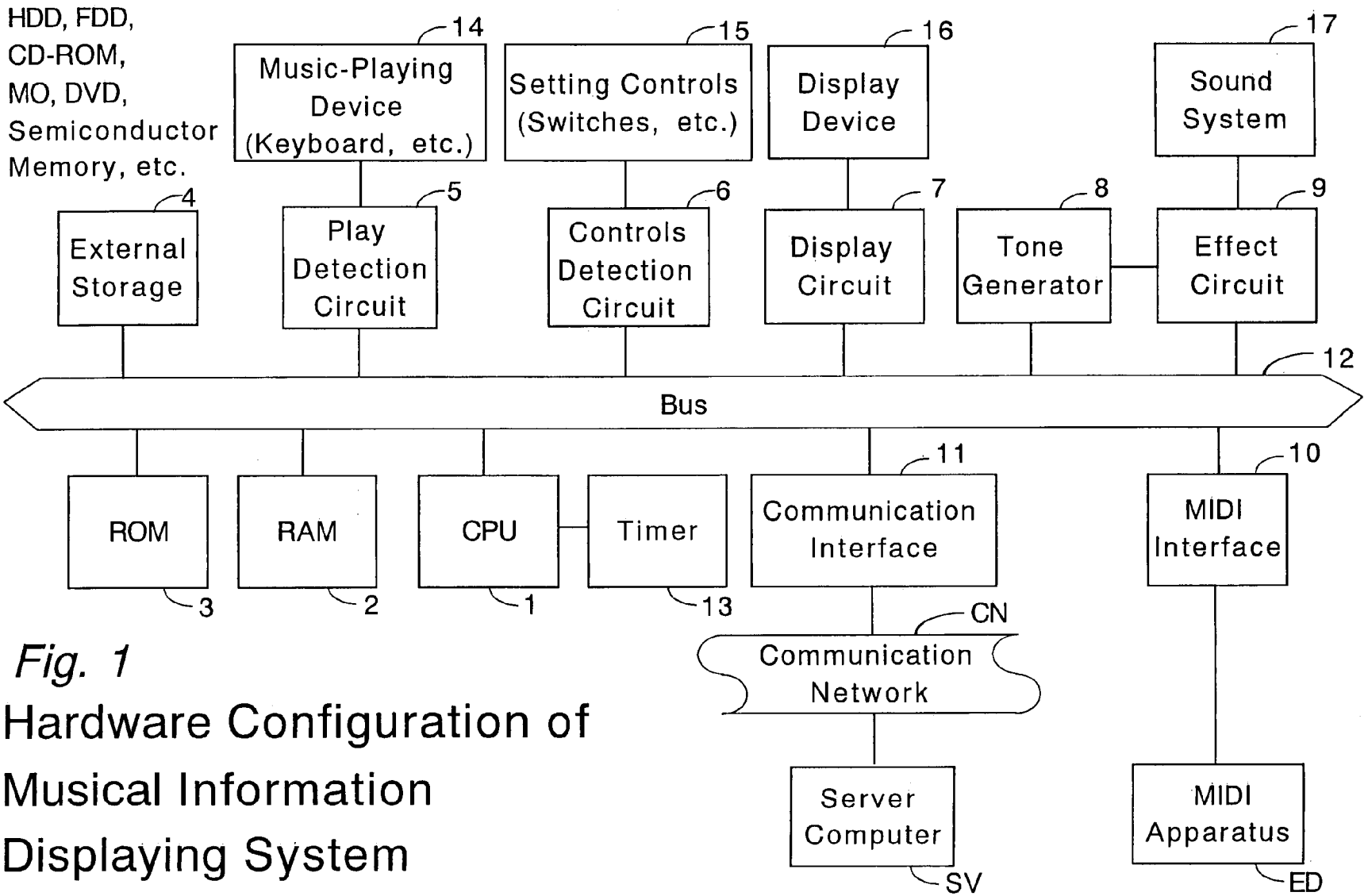
FIG. 1 is a block diagram illustrating the overall hardware configuration of a musical information displaying system according to an embodiment of the present invention.

The present invention will now be described in detail with reference to the drawings showing preferred embodiments thereof. It should, however, be understood that the illustrated embodiments are merely examples for the purpose of understanding the invention, and should not be taken as limiting the scope of the invention.

Overall System Configuration

FIG. 1 shows a block diagram illustrating the overall hardware configuration of a musical information displaying system according to an embodiment of the present invention. An electronic musical apparatus as a main setup of the musical information displaying system is comprised of a musical information processing apparatus (computer) such as a personal computer (PC) and an electronic musical instrument having musical information processing functions. In the embodiment of FIG. 1, the electronic musical apparatus comprises a central processing unit (CPU) 1, a random access memory (RAM) 2, a read-only memory (ROM) 3, an external storage device 4, a play detection circuit 5, a controls detection circuit 6, a display circuit 7, a tone generator circuit 8, an effect circuit 9, a MIDI interface 10 and a communication interface 11, all of which are connected with each other by a system bus 12.

The CPU 1 conducts various musical information processing including musical information displaying processing according to a given control program utilizing a clock signal from a timer 13. The RAM 2 is used as work areas for temporarily store various data necessary for the processing. The ROM 3 stores beforehand various control programs including the musical information displaying program and music performance data for a demonstration purpose for the execution of the processing.

The external storage device 4 may include a built-in storage medium such as a hard disk (HD) as well as various portable external storage media such as a compact disk read-only memory (CD-ROM), a flexible disk (FD), a magneto-optical (MO) disk, a digital versatile disk (DVD), a small-sized memory card like Smart Media (trademark) and so forth. Thus, the electronic musical apparatus can process any of the music performance data stored in any type of external storage device 4.

The play detection circuit 5 detects the user's operations of a music-playing device 14 such as a keyboard, and the control detection circuit 6 detects the user's operations of the setting controls 15 such as key switches and a mouse device. The both detection circuits 5 and 6 introduce the information (data) of the detected operations into the musical information displaying system. Among the setting controls 15 is further included, for example, a start/stop switch for commanding the start and the stop of the playback of music performance data.

The display circuit 7 is connected to a display device 16 (including various indicators) for displaying various screen images and pictures (and various indications), and controls the displayed contents and lighting conditions of these devices according to instructions from the CPU 1, and also presents GUIs for assisting the user in operating the various controls 15 and the music-playing device 14. Further, the display circuit 7 causes the display device 16 to display a music score which includes chord names and words on the display screen based on the music performance data from the memory 3 or the storage 4 during the musical information displaying processing.

The tone generator circuit 8 generates musical tone signals as determined by the musical tone data obtained from the processing of the real-time performance information based on the real-time music playing operation on the music-playing device 14 or of the music information based on the music performance data stored in the memory 3 or the storage 4. The effect circuit 9 includes an effect imparting DSP (digital signal processor) and imparts intended tone effects to the musical tone signals outputted from the tone generator circuit 8. To the effect circuit 9 is connected a sound system 17, which includes a D/A converter, an amplifier and a loudspeaker, and emits audible sounds based on the effect imparted musical tone signals. When a musical performance is played back by means of the musical performance outputting arrangement 8, 9 and 17 based on the music performance data (i.e. automatic performance data) stored in the memory 3 or the storage 4, the displaying arrangement 7 and 16 can display a music score based on the music performance data according to an instruction by the user.

To the MIDI interface 10 is connected another MIDI apparatus ED so that MIDI musical data including music performance data are exchanged and used in this system. The communication interface 11 is connected to a communication network CN such as the Internet and a local area network (LAN) so that a control program can be downloaded from an external server computer SV or the like, or so that a music performance data file can be received and temporarily stored in the RAM 2 or further in the external storage 4 for later use in this system.

While the system illustrated in FIG. 1 has a music-playing function, the system of the present invention may not necessarily be equipped with a music-playing function. Then, the music playing input arrangement such as the music-playing device 14 and the play detection circuit 5, and the music playing output arrangement such as the tone generator circuit 8, the effect circuit 9 and the sound system 17 may not be provided. Further, this system may not necessarily be externally connected with the MIDI apparatus ED and the server computer SV, and then the MIDI interface 10 and the communication interface 11 may not be provided, either.

Displayed Chord Names and Words

A musical information displaying system according to an embodiment of the present invention analyzes the music performance data containing a progression of notes together with the chord names and/or the words in association with the notes to detect possible overlaps of the chord names or the words when displayed along the time axis of the music staff, and displays the chord names at vertically shifted positions to prevent overlapping and the words at horizontally shifted positions to prevent overlapping with the adjacent words, and also displays the chord names with their root note name in a highlighted appearance especially in the case of a non-root-bass chord or on chord. FIGS. 2*a*–2*f* are charts in musical notation illustrating the rules for displaying the chord names and the words by the musical information displaying system according to embodiments of the present invention.

Referring now to FIGS. 2*a*–2*f*, the characteristic functions of the music information displaying system. When the chord names (in character strings) ca–ci are displayed on a musical staff, if there are overlaps in the direction of the time axis of the musical staff between adjacent chord names such as between cc and cd, cd and ce, cf and cg, and cg and ch, the display positions of the latter chord names cd, ce, cg and ch of the adjacent twos are vertically shifted from the display positions of the former chord names cc, cd, cf and cg of the adjacent twos, respectively (FIG. 2*a*), in which the chord name ce which overlaps with the preceding chord name cd but does not overlap with the further preceding chord name cc is displayed in the open space after the chord name cc. In the case of the chord name ck of "Dm7/C" (D minor seventh on bass C), the character "D" representing the root note of the chord is displayed in a different (highlighted) fashion from the other characters in the chord name (FIG. 2*b*). When the words (i.e. character strings) are displayed on the musical staff, if there is an overlap in the direction of the time axis of the musical staff between adjacent words such as between wa and wb (FIG. 2*c*), the display position of the latter word wb is shifted forward in the direction of the time axis (FIG. 2*d*). If the rightmost word wd overruns (exceeds) the right end Ed of the musical staff after prevention of the overlapping (FIG. 2*e*), the positions of the words wc and wd are remodified by right-justifying to the right end Ed of the musical staff (FIG. 2*f*).

The main rules for displaying the chord names and the words will be described in more detail herein-below with reference to FIGS. 2*a*–2*f*. When a music performance data file is selected for the display of its music score by the user operating the setting controls 15 to select the music piece, the musical information displaying system provides the music performance data of the selected music piece out of the memory 3 or the storage 4, and determines, according to the fundamental display processing functions of the musical information displaying processing program, the number of staff tiers (rows of five-line staffs) to constitute the musical score and the allocation of measures (positions of the bar lines) for each staff tier, and further the shapes and the positions of the symbols such as the clefs, the key signatures, the time signatures, the notes and the rests, and also controls the display positions of the chord names and the words and the character display fashion of the chord names according to the predetermined chord displaying rules and word displaying rules included in the musical information displaying processing program.

FIGS. 2*a*–2*f* show a length of or parts of musical staff of some music piece as displayed based on the music performance data for the music piece, in which the time progresses from left to right in the Figures. In the Figures, the horizontal direction of the time progression is called the time direction (or time axis), and the positions along the time axis are called time positions. The direction perpendicular to the horizontal time direction (time axis) is called the vertical direction, and the positions in the vertical direction are called vertical positions. In FIG. 2*a*, the reference characters L5, Br and Ed denote the fifth line of the musical staff, the bar lines between the measures and the right end of the staff tier, respectively, with musical symbols other than the clef being omitted from the display here. In FIGS. 2*d*–2*f*, the reference characters na–nd denotes the note symbols.

Back to FIGS. 2*a*–2*b*, these Figures are to explain the rules for displaying the chord names. The musical information displaying system of the present invention determines the time positions and the vertical positions and also the character display fashion of the chord name character strings ca–cm according the chord display rules. The character strings notating chord names will be sometimes referred to as "chord name notations" or "chord names" or "chords," and may be sometimes termed generally as "chord displays." Although the contents of the chord name notating character strings ca–ci are not specifically indicated in FIG. 2*a*, they may be such character strings as "C" and "Dm7/C" (including a string consisting of a single character).

The present system can create chord display data for displaying chords without an overlap and with a clear root note using the chord displaying rules as explained more specifically herein-below. In the context of the present invention, the term "overlap" means not only the state in which some characters of adjacent displays overlaps with each other but also the state in which the adjacent displays are not sufficiently separated from each other by more than a predetermined minimum gap for clear legibility.

Rule 1: A chord name notation which overruns the right end of each staff (Five-Line) tier will be right-justified by shifting leftward.

In the present system, the display length of each of the chord name notating character strings is determined from the chord information in each chord event information contained in the music performance data, and the head display position of each chord name notating character string is determined from the time information in each chord event information contained in the music performance data so that each chord name will be displayed at the corresponding time position along the time axis in view of the progression of the musical performance. However, the time position of the chord name notation ci which overruns the right end Ed of the staff tier as shown by a broken line at the rightmost part of FIG. 2*a* will be modified by shifting the entire character string leftward so that the right end of the chord name agrees with the staff end Ed. In other words, the head position of the chord name ci will be modified to the position which is prior to the end Ed of the staff tier by the amount of the display length Li of the chord name ci.

Rule 1a: A chord name notation which bridges intermediate measures across a bar line Br on a staff tier will be displayed regardless of the bar line.

According to the rules observed by the present system, the time positions of the chord names will not be modified except for the case where the above rule 1 is applied. The chord names may, therefore, be displayed over a bar line Br other than the right end bar line Ed as shown at the chord name cb in FIG. 2*a*.

Rule 2: The vertical positions of the chord names will be determined with the priority order of from the nearest space to the staff tier to the farther spaces (Fundamental Rule).

For example, in FIG. 2*a*, in the case of the chord name ca where there is no chord name before this chord name along the time axis, and in the case of the chord name cb where there is a space which is larger than a predetermined minimum gap (preferably greater than zero, but may be zero) from the tail of the preceding chord name ca (in other words, the two chord names ca and cb are legibly apart from each other when aligned along the time axis), the vertical positions of the chord names ca and cb are preferentially determined to be at the fundamental level which is above and nearest to the musical staff (i.e. in the vicinity of the uppermost or fifth line L5 of the musical staff). This fundamental rule is also applied to the chord name displays cc, ce, cf and ci.

Rule 3: With respect to consecutive chord names overlapping along the time axis, the latter chord name will be shifted vertically to prevent an overlap with the former (preceding) chord name.

For example, in the case of the chord name cd where the head position of the chord name cd comes before the tail of the preceding chord name cc (this does not overlap with the further preceding chord name cb) along the time axis (or where the head position would be too close to the tail position of the preceding chord name), in other words where the chord name cd overlaps with the chord name cc, the display position of the latter chord name cd is shifted in the vertical direction by an amount necessary to describe the character chain of the chord name cc so that the chord name cd will be displayed at an upper level above the preceding chord name cc. Further, for example, in the case of the chord name ce where there are three consecutive chord names cc, cd and ce which successively overlap with the preceding chord names, the vertical position of the second chord name cd will be determined with respect to the first chord name cc, and then the vertical position of the third chord name ce will be determined with respect to the second chord name so that the chord names will be properly shifted vertically to prevent overlapping.

Rule 3a: With respect to three or more consecutive chord names overlapping successively along the time axis, the vertical positions of the chords will be determined preferentially to be at open spaces nearer to the staff, while the vertical positions of the chords will be successively shifted apart from the staff only if there is no open space left nearer to the staff.

For example, in the cases of the three consecutive chord names cc–ce and cf–ch, the chord notations cc and cf are displayed at the vertical level nearest to the staff, and then the chord notations cd and cg cannot be displayed at the same nearest vertical level and accordingly will be shifted above the chord names cc and cf to be displayed at the second nearest vertical level. In the case of the chord name ce, there is an open space at the vertical level nearest to the staff, as the chord name notation ce does not overlap with the chord name notation cc along the time axis and as the preceding chord name notation cd is shifted away from the staff to prevent an overlap with the chord name notation cc, and thus the vertical position of the chord name notation ce will be determined according to the fundamental rule of the above "Rule 2" and will not be shifted vertically. On the other hand, in the case of the chord name ch, which overlaps with both of the two preceding chord names cf and cg, there is no open space left at the nearest vertical level and thus the display position for the chord name ch is shifted farther from the staff as shown in FIG. 2*a*.

Rule 4: The character denoting the root note of the chord will be highlighted.

As shown in FIG. 2*b*, the characters denoting the root notes of the chords (root characters for short) such as "C" in the case of the chord name character string cj of the C (C major) chord and "D" in the case of the chord name character string ck of the Dm7/C (D minor seventh on base C) chord will be displayed in a highlighted fashion with a thicker or a larger font. Especially in the case of an on-bass chord like the chord name notation ck, the highlighted root character "D" as compared with the on-bass note name "C" can clearly indicate the head character "D" of the chord name character string, that is the root note and the time position of the chord ck. To highlight the root character, the character may be in a larger font and/or in a thicker font such as bolt type and Gothic type as shown in FIG. 2*b*. The characters other than the root character in the chord name character string ck may be in a non-highlighted fashion (for "m7/") or in a depressed fashion (for "C"). Various other fashions will be available for highlighting the root character. In FIG. 2*b*, the on-bass chord ck is expressed using the symbol "/" for the on-bass note "C" but the same chord name may be expressed as "Dm7 on C" as shown at the chord name string cm. In both cases, the root note "D" is highlighted on the musical staff.

FIGS. 2*c*–2*f* are to explain the rules for displaying the words. The musical information displaying system of the present invention first determines the lengths and the time positions of the words to be displayed along the time axis, and then modifies the display positions of the words to prevent overlaps, if any, between the adjacent words or an overrun at the right end of the staff tier according the word display rules as will be described in detail herein below. The words will be displayed along with the notes on the musical staff in a clearly legible appearance. The character strings notating words will be sometimes referred to as "word notations" or "words," and may be sometimes termed generally as "word displays."

Rule 5: The words are displayed fundamentally at the time positions of the corresponding note symbols along the time axis and on the word line of the musical staff as long as adjacent words do not overlap with each other.

Also with respect to the word notating character strings, the display lengths are determined from the word information in each word event information contained in the music performance data, and the head display position of each word notating character string is determined from the time information (usually at the same on-time as the main note event) in each word event information contained in the music performance data so that each word will be displayed at the corresponding time position along the time axis in view of the progression of the musical performance. If thus determined display positions do not cause overlaps between the adjacent words on the word display line (more particularly, there is a gap larger than a predetermined minimum word gap between the head position, i.e. left end position of a word and the tail position, i.e. right end position of the preceding word), the words will be displayed at the determined positions corresponding to the associated note symbols.

Rule 6: If the adjacent words would overlap with each other when displayed at the positions corresponding to the associated note symbols in the musical staff, the head position of the latter word is shifted in the direction of the time progression, i.e. rightward to prevent an overlap when displayed.

If the above determined word positions (according to Rule 5) will cause an overlap between two adjacent words as shown in FIG. 2*c*, in which the head position of the word notation character string wb representing the word "Kong" which corresponds to the note symbol nb comes before the tail position of the word notation character string wa representing the word "Hong" which corresponds to the note symbol na (or comes after the latter leaving only an insufficient space less than the above-mentioned minimum word gap), the system judges that there is an overlap between the two words wa and wb and modifies the head position of the latter word wb by shifting it to the position which is after the head position of the word wa by the amount of the word length La plus the minimum word gap as shown in FIG. 2*d*. The minimum word gap may preferably be about a single space, but may be zero. In other words, where the first determined word positions would cause overlaps between the words when displayed, the latter word (e.g. wb which is "Kong") will be shifted rightward to prevent from overlapping with the former word (e.g. wa which is "Hong").

Rule 7: If a displayed word would overrun the right end of a staff tier, words in the same line will be successively right-justified with respect to the staff tier.

If the system judges that the word notation character string wd representing the word "Kong" which corresponds to the note symbol nd at the end of the staff tier as determined according to the above Rule 5 overruns (exceeds) the right end Ed of the staff tier as shown in FIG. 2*e*, the head position of the word wd to a position which is before the right end Ed of the staff tier by the amount of the word display length Ld of the word character string wd as shown in FIG. 2*f*. Thus, the word notation wd will be right-justified with respect to the right end Ed of the staff tier. If the preceding word notation character string wc which is "Hong" (corresponding to the note symbol nc) would then overlaps with the thus right-justified word wd, the head position of the preceding word notation wc will be shifted to the position which comes before the head position of the word notation wd by the amount of the display length Lc (plus a necessary word gap as predetermined). Likewise, the positions of the words in the same word line are successively adjusted until there will be no overlap between words in the same word line. This Rule 7 may preferably be applied from the rightmost word for the staff tier, after the positions of the words for one staff tier have been once determined from the leftmost word for the same staff tier according to the above Rule 6. For example, if the words would be displayed according to the respective head positions of the respective words based on the word events, the words wc and wd would be displayed with an overlap as shown in FIG. 2*e* (upper occurrence). Then, the above Rule 6 is applied to the latter word wd which is "Kong" so that the display position of the word wd ("Kong") will be shifted rightward to prevent an overlap with the word wc ("Hong"). Then, the word wd ("Kong") would overrun the right end Ed of the staff tier as shown in FIG. 2*e* (lower occurrence). Then, this Rule 7 is applied to the right end word wd to right-justify the same and successively the other words in the same line backward, so that the words wc and wd are displayed in a clear legible appearance as shown in FIG. 2*f*.

Chord Display Data and Word Display Data

A musical information displaying system according to an embodiment of the present invention creates chord display data and/or word display data from the music performance data in accordance with the music information displaying program, and displays the chord names and/or the words on the display screen based on the created display data, wherein the chord names and/or the words are displayed in a clearly legible appearance as explained herein-above. FIGS. 3*a* and 3*b* show, in combination, a flow chart describing the processing steps for creating chord display data, and FIGS. 4*a*–4*d* show, in combination, a flow chart describing the processing steps for creating word display data, as conducted by a musical information displaying system according to an embodiment of the present invention. FIG. 5 shows an example of the data format of the music performance data used in the musical information displaying system according to an embodiment of the present invention.

To begin with, an example of the data format of the music performance data (musical composition data) used in this system will be described with reference to FIG. 5. The memory 3 and/or the storage 4 stores a number of music performance data files Sn which may be called "music data" for short. Any one of the music data (music data files) can be selected according to the user's operation. A music performance data file Sn of the illustrated example comprises note event information En, chord event information Ec and word event information Ew which are aligned in the time sequence of the respective events. The note event information En of each note event contains time information Tm and note information Nt in a pair as expanded in the right side portion of FIG. 5. The note information Nt includes information about the note number, the gate time, the velocity and so forth of each note event.

Similarly, the chord event information Ec of each chord event contains time information Tm and chord information Ch in a pair as also expanded in the right side portion of FIG. 5. The chord information Ch of each chord event is information consisting of a character string used for each chord name notation ca–cm as described with reference to FIGS. 2*a*–2*b*, such as "C#M7aug" and "C/E." The word information Wr of each word event is information consisting of a character string used for each word wa–wd corresponding to the associated note symbol. The word character string may contain various kinds of characters including alphabets, numerals, symbols, hirakanas, kanjis, etc. Most of the character strings are of monosyllable words, and may be of individual syllables from polysyllable words.

In FIG. 5, the music performance data Sn for a single music composition contains event information about all the notes, all the chords and all the words of the music composition, but any other format may be employed as well. For example, the music performance data Sn for a single music composition may be divided into several separate data chunks. Further, the information about a single note event may contain both the information about the note event and the information about the word event at the same time point. While the illustrated music performance data format is of a single track configuration, the data format may be of a multi-track configuration.

The processing flow of FIGS. 3*a* and 3*b* for creating the chord display data starts with the selection of the music performance data Sn of an intended music composition and is executed through to the end for the selected music composition. As this processing flow starts, a first step P1 conducts various settings by the user including the selection of the music performance data Sn for displaying the musical score, the setting of the distances between the respective staff tiers (rows of five-line staff) according to the designation, and so forth.

The next step P2 surveys all the events in the selected music performance data Sn, determines the allocation of measures for each of the staff tiers and creates note display data for displaying symbols of notes and rests which constitute the music performance on the musical staffs based on the note event information En. This process can be realized by a conventional method for producing a music score, wherein the note display data created here contains information defining the positions, the shapes and the sizes of the symbols which represent the respective notes Nt in the music performance data Sn.

The following step P3 is to read out the chord event information Ec in the music performance data Sn event by event from the top event successively. A step P4 obtains the length necessary to display each chord name from the chord information Ch of the chord event under processing. There are various types of chord names including the chord name of an on-bass chord having a bass note name in addition to the chord root note as explained above with reference to FIG. 2*b*. The font to display the chord names are predetermined in the system (or may be determined by the user), and the display length of each chord name is determined based on the chord information Ch.

Then, a step P5 determines the head position of each chord name notation along the time axis for displaying the chord name (among ca–cm) on the musical staff from the time information Tm of the read-out chord event information Ec. The information of the determined head position is stored as the display position data in the chord display data. The head position of the chord name notation is preferably be determined at the time position along the time axis of the note symbol represented by the note display data (based on the note event information En at the same time point) corresponding to the time information Tm of the chord event information Ec. During the process of actually displaying the chord names, the left ends of the respective chord name character strings are placed at thus determined head positions of the respective chords along the time axis.

A step P6 judges whether the chord name display overruns the right end Ed of the staff tier or not. In other words, with the example of FIG. 2*a*, the step P6 judges whether the position obtained by adding the display length Li (and, if necessary, plus some word margin) of the chord name ci to the head position thereof comes after the right end Ed of the staff tier as shown by a broken line in FIG. 2*a* .

If the judgment at the step P6 is affirmative (Yes), the process flow goes forward to a step P7, which modifies (adjusts) the head position in the chord display data of the chord ci to right-justify the chord name notation with respect to the right end Ed of the staff tier according to the above Rule 1 as shown by a solid line in FIG. 2*a*.

After the head position of the chord name string is modified at the step P7, or when the step P6 judges negative (No), the process flow proceeds or skips to a step P8 to determine the vertical position of the chord name display to be in the space above and nearest to the staff tier (preferably some margin may be left between the chord notation and the fifth line L5 of the staff) according to the above Rule 2 , and the vertical position information of the chord display data is set to denote this nearest space.

The next step P9 judges whether or not the thus determined head position of the chord name display is too close to the tail of the preceding chord name display which is determined in the same vertical position by an amount less than the predetermined minimum gap (or overlapping) along the time axis. It should be understood that the chord event information Ec at the preceding time point denoted by the time information Tm has been previously processed and its position has been determined and stored in the chord display data.

If the judgment at the step P9 is affirmative (Yes), the process flow moves forward to a step P10, which modifies the vertical position information of the chord display data by shifting the vertical position of the chord name display (as determined at the step P8) to an open space above and nearest to the staff tier according the above Rules 3 and 3*a*. More specifically, where the current determined position is the position nearest to the staff tier, the vertical position will be shifted upward, but where the current determined position is not the position nearest to the staff tier, the vertical position will be shifted to an open space as selected the nearer to the staff the more preferable. The unit of vertical shifting may be the character height necessary for notating the chord names, or may be the minimum unit of the resolution of the display circuit 7. After the vertical position of the chord display is shifted at the step P10, the process flow goes back to the step P9 to judge whether the thus shifted vertical position causes an overlap with any of the previously determined chord display. If the step P9 judges there is an overlap again, the step P10 shifts the vertical position of the next preference before the process flow goes back to the step P9 again.

If the step P9 judges that the chord display at thus determined or modified vertical position does not overlap with another chord display, that is, judges negative (No), the process flow proceeds to a step P11 to judge whether or not the chord event information Ec for all the chord events in the music performance data Sn has been processed. If there is still the chord event information Ec of any chord event unprocessed, that is, if the step P11 judges negative (No), the process flow goes back to the step P3 to repeat the processing of the steps P3 through P11 with respect to the chord event information Ec of the next chord event remaining unprocessed. If the chord event information Ec of all the chord events has been processed, the step P11 judges affirmative (Yes), the processing for creating the chord display data of the selected music performance data file Sn comes to an end. After the creation of the chord display data is over, the system displays a music score based on the note display data and the chord display data thus created.

The processing flow of FIGS. 4*a*–4*d* for creating the word display data starts with the selection of the music performance data Sn of an intended music composition and is executed through to the end for the selected music composition. As this processing flow starts, a first step S1 conducts various settings by the user including the selection of the music performance data Sn for displaying the musical score. The next step S2 surveys all the events in the selected music performance data Sn, determines the allocation of measures for each of the staff tiers and creates note display data. The process contents in the steps S1 and S2 are the same as the steps P1 and P2 of the processing for creating the chord display data.

The following step S3 is to read out the word event information Ew in the music performance data Sn event by event from the top event successively. Then the process flow proceeds to a step S7. The step S7 obtains the length necessary to display each word from the word information Wr of the word event information Ew read out at the step S3. The process flow then goes forward to a step S4.

The step S4 determines the head position of each word along the time axis from the time information Tm for displaying the word to be displayed according to the word information Wr. The information of the determined head position is stored as the display position data in the word display data.

Next, a step S5 judges whether or not the thus determined head position of the word display is too close to the tail of the preceding (left) word display by an amount less than a predetermined minimum word gap (or overlapping). If the judgment at the step S5 is affirmative (Yes), the process flow goes forward to a step S6, which modifies (shifts leftward) the head position of the word display so that the head of the word will be apart from the tail of the preceding word by an amount of the predetermined minimum word gap.

After the head position of the word is modified at the step S6, or when the step S5 judges negative (No), the process flow proceeds or skips to a step S8 to judge whether or not the word under process is the one located at the right end Ed of the staff tier and the word display would overrun the right end Ed of the staff tier. If the step S8 judges that the word at the right end would overrun the right end Ed of the staff tier, that is, if the judgment at the step S8 is affirmative (Yes), the process flow passes through a justification routine including steps S9 through S16. If not, that is, if the judgment at the step S8 is negative (No), the process flow skips to a step S17 to judge whether or not the word event information Ew for all the word events in the music performance data Sn has been processed.

As long as there is any word event information Ew remaining unprocessed and while the word event under process is not of the right end word of a staff tier (i.e. the step S17 judges "No") or is of the right end word which does not overrun the right end Ed of the staff tier (i.e. the step S8 judges "No"), the process flow goes back to the step S3 to repeat the above-described processing at the steps S3–S8 and S17.

On the other hand, where the word. event under process is the right end word of a staff tier and the word display would overruns the right end Ed of the staff tier, the step S8 judges affirmative (Yes), the head position of the word display is modified to be right-justified with respect to the right end Ed of the staff tier at the step S9 (FIGS. 2*e* and 2*f*). Then, a step S10 sets the initial value of the working index for pointing the word event under process in the order of the event times to be "N," where the rightmost word is of the N-th word event in the music performance data Sn.

Next, a step S11 judges whether or not there is a preceding word event on the left of the word event pointed by the working index. If there is a preceding word event, the step S11 judges affirmative (Yes), the process flow goes to a step S12 (FIG. 4*c*), which judges whether the head position of the word event pointed by the working index is too close to the tail of the preceding word event by an amount less than the predetermined minimum gap (or overlapping), and if the judgment is negative (No), i.e. not too close, the process flow skips to the step S17 (FIG. 4*b*).

On the other hand, if the word event pointed by the index is too close to the left word event (or overlapping) as shown in FIG. 2*e* (upper occurrence), the step S12 judges affirmative (Yes), a step S13 then modifies the head position of the left word event to keep the minimum gap from the head position of the word event currently pointed by the working index as shown in FIG. 2*f*. Thereafter, a step S14 decrement the working index by "1" before going back to the step S11 (FIG. 4*b*). The processing loop of the steps S11 through S14 is repeated as long as there is a preceding word event and the preceding word event is too close to (or overlapping with) the current word event as pointed by the working index.

If there is no preceding word event remaining after the step S13 for modifying the head position of the preceding word event has been repeated, the step S11 judges negative (No), the process flow proceeds to a step S15, which judges whether or not the word event pointed by the working index overruns beyond the left end of the staff tier. If the word event does not extrude from the left end of the staff tier, the step S15 judges negative (No), the process flow goes forward to the step S17, while if the word event extrudes from the left end of the staff tier, the step S15 judges affirmative (Yes), the process flow goes forward to a step S16 (FIG. 4*d*).

After the process flow comes to the step S17, and if the step S17 judges that the word event information Ec has been processed for all the word events, i.e. affirmative (Yes), the process flow goes forward to a step S18 (FIG. 4*d*), which step sets a flag to indicate that the word display data have been successfully created, and the word display data creating processing with respect to the selected music performance data Sn comes to an end. Thus, when the word display data have been successfully created, the system displays a musical score of the music performance data Sn on the screen of the display device 14 based on the note display data and the word display data.

On the other hand, in the case the word event extrudes from the left end of the staff tier and the process flow comes to the step S16, the step S16 sets a flag to indicate that the word display data have not been successfully created, and word display data creating processing with respect to the selected music performance data Sn comes to an end. Where the word display data creating processing has not been successful, the system may retry the same processing after changing (i.e. decreasing) the size of the character font and the word gap, or changing the allocation of the measures in each staff tier. Or the characters which cannot be displayed (e.g. the part of the character string extruding beyond the right end of the staff tier) may be omitted.

While particular embodiments of the invention and particular modifications have been described, it should be expressly understood by those skilled in the art that the illustrated embodiments are just for preferable examples and that various modifications and substitutions may be made without departing from the spirit of the present invention so that the invention is not limited thereto, since further modifications may be made by those skilled in the art, particularly in light of the foregoing teachings. For example, while the musical score is displayed after all the chord display data and the word display data have been created, but the chords and the words may be displayed one after another every time the display position is established (determined and properly modified) successively. It is therefore contemplated by the appended claims to cover any such modifications that incorporate those features of these improvements in the true spirit and scope of the invention.

What is claimed is:

1. An apparatus for displaying musical information including a plurality of chords in association with notes displayed along a time axis on a musical staff comprising:

a music performance data providing device which provides music performance data containing note data representing notes in progression along a time axis to constitute a musical performance, and chord data representing chords in progression in association with said notes;

a first determining device which determines a display length and a display position of each of said chords along the time axis based on said chord data contained in said music performance data;

a detecting device which detects an overlap of chords in the direction of the time axis when displayed based on said determined display lengths and said determined display positions of the respective chords along the time axis;

a second determining device which determines a vertical display position of a chord of which no overlap with another chord is detected to be at a predetermined standard vertical position in a direction perpendicular to the time axis, and determines a vertical display position of a chord of which an overlap with another chord is detected to be at a vertical position which is vertically apart from said other chord by at least a predetermined gap; and a display device which displays each of the chords at the position in the direction of the time axis as determined by said first determining device and at the vertical position as determined by said second determining device.

2. An apparatus as claimed in claim 1, wherein said detecting device detects at least two consecutive overlaps among at least three consecutive chords, wherein said standard vertical position is a position vertically nearest to said musical staff; and wherein said second determining device determines a vertical position of a chord among said consecutive chords at a position vertically as near to said musical staff as possible, provided that said chord does not overlap with another of said consecutive chords in the direction of the time axis.

3. An apparatus for displaying musical information including a plurality of chords in association with notes displayed along a time axis on a musical staff comprising:

a music performance data providing device which provides music performance data containing note data representing notes in progression along a time axis to constitute a musical performance, and chord data representing at least a chord in association with said notes; and a display control device which controls said display device to display a chord name comprised of a character string based on said chord data contained in said music performance data such that a character representing the root of said chord is displayed in a different fashion from characters in said character string other than said character representing the root.

4. An apparatus for displaying musical information including a plurality of words in correspondence to notes displayed along a time axis on a musical staff comprising:

a music performance data providing device which provides music performance data containing note data representing notes in progression along a time axis to constitute a musical performance, and word data representing words in progression in association with said notes;

a determining device which determines a display length and a display position of each of said words along the time axis based on said word data contained in said music performance data;

a detecting device which detects an overlap of words in the direction of the time axis when displayed based on said determined display lengths and said determined display positions of the respective words along the time axis successively from a top word to subsequent words;

a modifying device which modifies, when said detecting device detects an overlap of two adjacent words in the direction of the time axis, the position of the latter of said two adjacent words to a position which is apart from the former of said two adjacent words by at least a predetermined word gap in the direction of the time axis without expanding the length of the bar associated with the overlapping words along the time axis; and a display device which displays the word of which the position is not modified at the position determined by said determining device, and displays the word of which the position is modified at the position modified by said modifying device.

5. An apparatus as claimed in claim 4, further comprising:

a judging device which judges whether a word to be displayed at the rightmost end along the time axis on the musical staff overruns the right end of the musical staff; and a remodifying device which remodifies the position of the word which is judged to overrun the right end of the musical staff to a position which is right-justified with respect to the right end of said musical staff, and remodifies the positions of the preceding words to prevent overlapped display, if any, of such words, wherein said display device displays said right-justified word and said preceding word, if any, to be displayed at the positions remodified by said remodifying device.

6. A computer readable medium containing program instructions executable by a computer for causing said computer to execute:

a process of providing music performance data containing note data representing notes in progression along a time axis to constitute a musical performance, and chord data representing chords in progression in association with said notes;

a process of determining a display length and a display position of each of said chords along the time axis based on said chord data contained in said music performance data; a process of detecting an overlap of chords in the direction of the time axis when displayed based on said determined display lengths and said determined display positions of the respective chords along the time axis;

a process of determining a vertical display position of a chord of which no overlap with another chord is detected to be at a predetermined standard vertical position in a direction perpendicular to the time axis, and determining a vertical display position of a chord of which an overlap with another chord is detected to be at a vertical position which is vertically apart from said other chord by at least a predetermined gap; and a process of displaying each of the chords at the position in the direction of the time axis as determined by said process of determining a display length and a display position and at the vertical position as determined by said process of determining a vertical display position, thereby displaying musical information including a plurality of chords in correspondence to the notes displayed along the time axis on the musical staff.

7. A computer readable medium containing program instructions executable by a computer for causing said computer to execute:

a process of providing music performance data containing note data representing notes in progression along a time axis to constitute a musical performance, and word data representing words in progression in association with said notes;

a process of determining a display length and a display position of each of said words along the time axis based on said word data contained in said music performance data;

a process of detecting an overlap of words in the direction of the time axis when displayed based on said determined display lengths and said determined display positions of the respective words along the time axis successively from a top word to subsequent words;

a process of modifying, when said process of detecting detects an overlap of two adjacent words in the direction of the time axis, the position of the latter of said two adjacent words to a position which is apart from the former of said two adjacent words by at least a predetermined word a in the direction of the time axis without expanding the length of the bar associated with the overlapping words along the time axis; and a process of displaying the word of which the position is not modified at the position determined by said process of determining, and displaying the word of which the position is modified at the position modified by said process of modifying, thereby displaying musical information including a plurality of words in correspondence to the notes displayed along the time axis on the musical staff.

* * * * *

UNITED STATES PATENT AND TRADEMARK OFFICE

CERTIFICATE OF CORRECTION

PATENT NO. : 7,220,909 B2
APPLICATION NO. : 11/233390
DATED : May 22, 2007
INVENTOR(S) : Tomoyuki Funaki It is certified that error appears in the above-identified patent and that said Letters Patent is hereby corrected as shown below:

Title Page, Item (73) Assignee: The Assignee is incorrect and should appear as follows:

--Yamaha Corporation--

Signed and Sealed this

Twenty-first Day of August, 2007

JON W. DUDAS
*Director of the United States Patent and Trademark Office*